US006179178B1

(12) United States Patent
Stegmeyer

(10) Patent No.: US 6,179,178 B1
(45) Date of Patent: Jan. 30, 2001

(54) NON-SLIP CARRYING STRAP

(76) Inventor: Alfred W. Stegmeyer, 9601 Miccosukee Rd., No. 31, Tallahassee, FL (US) 32308

( * ) Notice: Under 35 U.S.C. 154(b), the term of this patent shall be extended for 0 days.

(21) Appl. No.: 09/328,016

(22) Filed: Jun. 8, 1999

(51) Int. Cl.[7] ..... A41F 15/02

(52) U.S. Cl. ..... 224/264; 224/257; 224/600; 428/156; 428/188

(58) Field of Search ..... 224/264, 257, 224/901, 600; 2/267, 268; 428/156, 167, 188

(56) References Cited

U.S. PATENT DOCUMENTS

| | | | | |
|---|---|---|---|---|
| 2,477,151 | | 7/1949 | Stapleton . | |
| 2,608,326 | | 8/1952 | Spector . | |
| 4,125,904 | | 11/1978 | Levine . | |
| 4,879,768 | | 11/1989 | McClees et al. . | |
| 4,925,724 | | 5/1990 | Ogden . | |
| 4,930,196 | | 6/1990 | Laurin . | |
| 4,978,044 | * | 12/1990 | Silver | 224/264 |
| 5,250,345 | * | 10/1993 | Chu | 428/156 |
| 5,292,044 | | 3/1994 | Reimers . | |
| 5,307,966 | * | 5/1994 | Inaba et al. | 224/151 |
| 5,507,422 | * | 4/1996 | Shields | 224/264 |
| 5,566,871 | | 10/1996 | Weintraub . | |
| 5,573,306 | | 11/1996 | Galloway et al. . | |
| 5,860,228 | | 1/1999 | Buthum . | |

FOREIGN PATENT DOCUMENTS

| | | | | |
|---|---|---|---|---|
| 767014 | * | 1/1957 | (GB) | 224/264 |

* cited by examiner

*Primary Examiner*—Gregory M. Vidovich
*Assistant Examiner*—Maerena W. Brevard

(57) ABSTRACT

A non-slip carrying strap is used to carry loads over the shoulder or on the shoulder and helps prevent the strap from coming off of the shoulder. The non-slip carrying strap has a strap, the ends of which are attached to a load in conventional fashion. A flexible buffer member is attached to the medial portion of the strap. An elongate substantially flat body member has a plurality of knobby-nips disposed on substantially all of its outer surface and has a hollow interior that receives the buffer member. A first end portion encompasses and attaches to the two ends of the buffer member and the body member, while a second end portion encompasses the opposing ends of the two members.

6 Claims, 2 Drawing Sheets

NON-SLIP CARRYING STRAP

BACKGROUND OF THE INVENTION

1. Field of the Invention

The present invention relates to a strap that carries loads on a user's shoulder and helps prevent slippage of the strap from the shoulder.

2. Background of the Prior Art

Shoulder straps are used to carry a variety of items such as cameras, luggage, guns, etc. One of the major concerns of such straps is to keep the strap firmly on the shoulder of the user and prevent the strap from slipping off. Regular wearers of shoulder straps tend to find themselves tilting to one side as they walk in order to prevent the strap from slipping off of the user's shoulder. Several devices have been proposed to prevent such slippage. Many items that are currently found in the art simply do not prevent strap slippage under even minor loading. Other devices work only partially, for instance if the strap flips over—as they often do—the slip prevention feature fails. Other devices have undesired side effects, for instance the shoulder contact point of the strap will tend to bend along its longitudinal axis forming a V, with the pointed base of the V digging into the user's shoulder.

Therefore, there is a need in the art for a shoulder strap system that does not roll off or slip off of the shoulder under most conditions and that does not have undesired side effects. such a shoulder strap should be of relatively simple design and construction and should be easy to use.

SUMMARY OF THE INVENTION

The non-slip carrying strap of the present invention addresses the aforementioned needs in the art. The strap, designed to be worn on a user's shoulder, provides effective non-slip characteristics and helps prevent slippage off of the shoulder under most loading conditions. The device works effectively even when the strap flips or twists, and does not tend to bend along its longitudinal axis. The non-slip carrying strap is of relatively simple design and construction and is easy to use.

The non-slip carrying strap of the present invention is comprised of an elongate generally flexible body member having a hollow interior, a first end, a second end, and an outer surface that has a top surface, a bottom surface, a first side surface, a second side surface. A plurality of knobby-nips are located on the top surface, the bottom surface, the first side, and the second side. The body member and the plurality of knobby-nips are each made from an appropriate polymeric material. A strap of conventional design is received within the hollow interior of the body member. The strap is attached to the body member in desired fashion such as by tacking or stapling, sewing or the use of an adhesive. A flexible buffer member can also be disposed within the hollow interior of the body member and attached to the body member and to the strap (the buffer member may be hollow and the strap disposed within the hollow interior of the buffer member before being attached thereto) in desired fashion. The buffer member is dimensioned to substantially fill the hollow interior of the body member and to have the buffer member's ends extend beyond the ends of the body member. A first leather portion or plastic portion encompasses and is attached to the first ends of the buffer member and the body member while a second leather portion or plastic portion encompasses and is attached to the opposing other ends of the buffer member and the body member.

BRIEF DESCRIPTION OF THE DRAWINGS

Similar reference numerals refer to similar parts throughout the several views of the drawings.

DESCRIPTION OF THE PREFERRED EMBODIMENT

Figure 1:
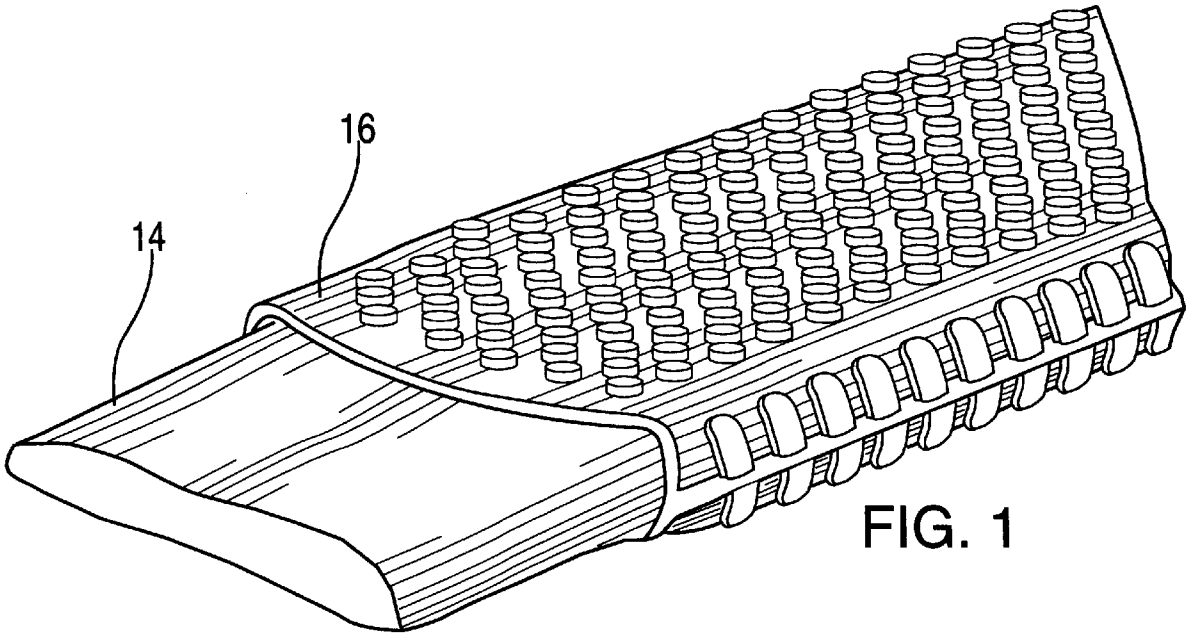
FIG. 1 is a perspective view of the non-slip body member of the non-slip carrying strap of the present invention.
Figure 2:
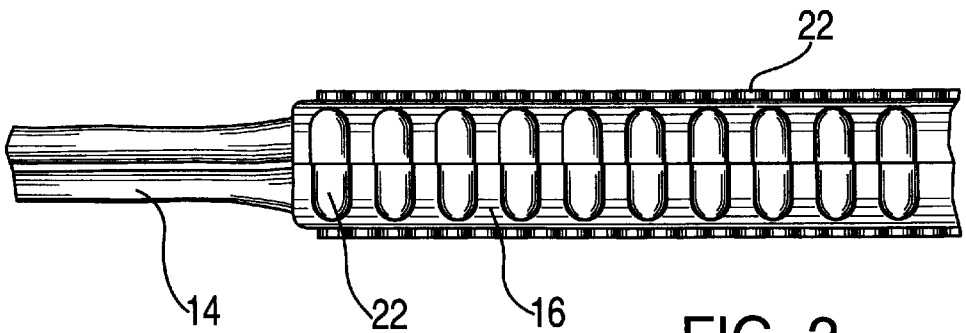
FIG. 2 is a side elevation view of the non-slip body member.
Figure 3:
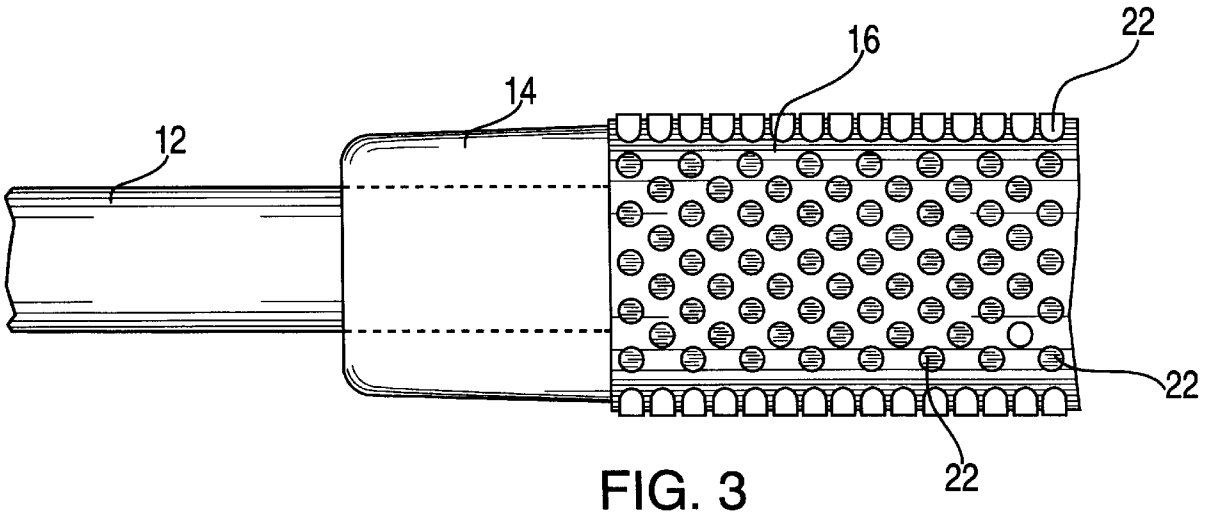
FIG. 3 is a top plan view of the non-slip carrying strap of the present invention utilizing narrow width straps.
Figure 4:
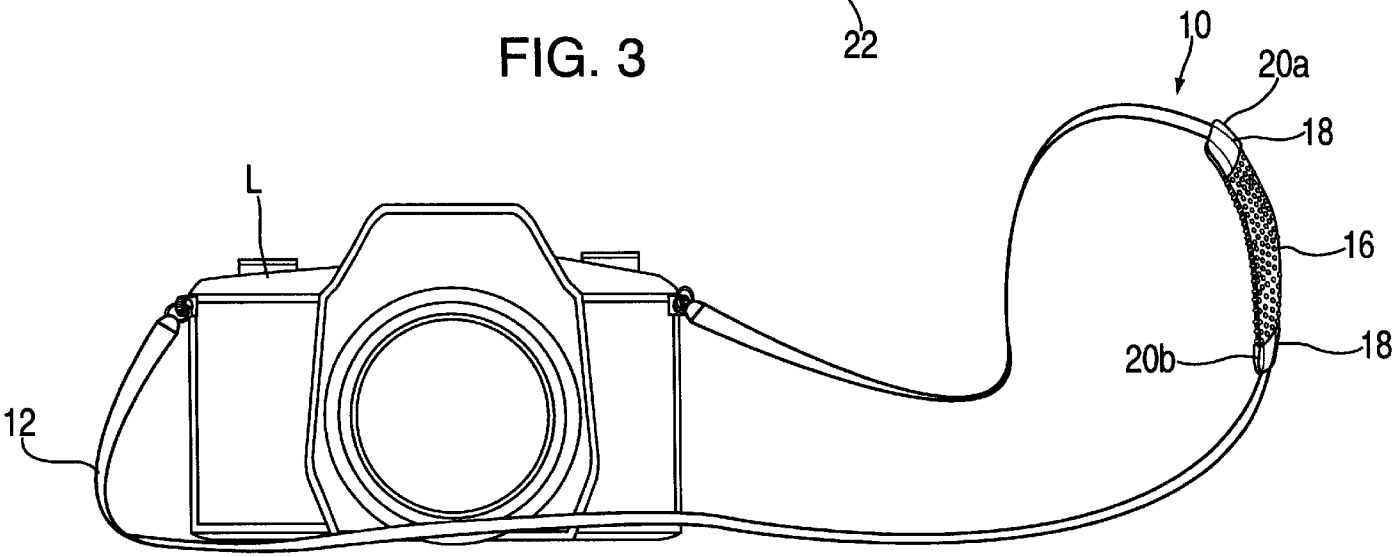
FIG. 4 is an environmental view of the non-slip carrying strap attached to a load.

Referring now to the drawings, it is seen that the non-slip carrying strap of the present invention, generally denoted by reference numeral 10, is comprised of a strap 12. The strap 12 is made from any appropriate material such as nylon, cotton, leather, etc., and has a pair of ends that are attached to a load L in conventional fashion. A flexible buffer member 14 is attached to the strap 12, with the strap 12 being attached to the buffer member 14 in any desired fashion such as by an adhesive, tacking, hot molding, or sewing. The buffer member 14 is made from an appropriate polymeric material, such as rubber, neoprene, nylon and the like. A flexible elongate body member 16 has a hollow interior and an outer surface with a top, a bottom, a first side, and a second side. The hollow interior of the body member 16 receives the buffer member 14 such that the ends of the buffer member 14 extend beyond the ends of the body member 16. The dimensions of the buffer member 14 are similar to the dimensions of the hollow interior of the body member 16 such that the buffer member 14 substantially fills the hollow interior of the body member 16. The buffer member 14 is attached to the body member 16 in any desired fashion such as by adhesive, tacking or sewing (if sewing is used, one set of stitches 18 can be used to join the strap 12, the buffer member 14, and the body member 16 together). The body member 16 is made from an appropriate polymeric material, such as rubber, neoprene, nylon and the like. If desired, a first end portion 20*a* can be wrapped around and attached to the first ends of the buffer member 14 and the body member 16, while a second end portion 20*b* can be wrapped around and attached to the opposing second ends of the buffer member 14 and the body member 16. The end portions 20*a* and 20*b* are made from leather or plastic. Attachment of the end portions 20*a* and 20*b* can be in any desired fashion such as by using an adhesive, tacking, molding, or sewing.

A plurality of knobby-nips 22 is disposed on the outer surface of the body member including on the top, the bottom, the first side and the second side. The knobby-nips 22, which can have a variety of geometric shapes—including the circular and semi-ovular illustrated—can be integrally formed with the body member 16 and be made of the same material as the body member 16. The size of the knobby-nips 22 and the density of the knobby-nips 22 is dependent on the particular target application of the device 10 (for example, smaller knobby-nips 22 provide better grip while larger knobby-nips 22 are better suited for larger loads).

In order to use the non-slip carrying strap 10 of the present invention, the particular dimensions (length, width, knobby-nip 22 size and knobby-nip 22 density) of the body member 16 are selected and the ends of the strap 12 are attached to the load L to be carried and the device 10 is placed onto the user's shoulder such that the body member 16 rests on the shoulder. The flexible nature of the body member 16 assures a good fit of the device 10 onto the shoulder. The knobby-nips 22 grip the shoulder and help prevent the device 10 from slipping off of the shoulder. As the knobby-nips 22 are disposed on all sides of the outer surface of the body member 16, the device 10 will be maintained on the shoulder even if the body member 16 twists or rolls while on the shoulder. The body member 16 combined with the buffer member 14 (and to a small extent the two end portions 20*a* and 20*b*) help keep the body member 16 from bending along its longitudinal axis and forming a V. By preventing such bending, an entire surface (either the top surface or the bottom surface) of the body member 16 is maintained on the shoulder thereby spreading the weight of the load on a relatively large area of the shoulder of the user.

While the invention has been particularly shown and described with reference to an embodiment thereof, it will be appreciated by those skilled in the art that various changes in form and detail may be made without departing from the spirit and scope of the invention.

I claim:

1. A non-slip carrying strap comprising:

an elongate generally flexible body member having a hollow interior, a top surface, a bottom surface, a first side surface, a second side surface, a first end, and a second end;

a plurality of knobby-nips located on the top surface, the bottom surface, the first side, and the second side; and a flexible buffer member, having a third end, and a fourth end, disposed within the hollow interior of the body member and attached to the body member a strap having a fifth end, a sixth end, and a medial portion received within the hollow interior of the body member, the strap being attached to the buffer member.

2. The non-slip carrying strap as in claim 1 wherein the body member and the plurality of knobby-nips are each made from a polymeric material.

3. The non-slip carrying strap according to claim 1 further comprising:

encircling wraps encompassing and attached to the respective first and second ends.

4. A non-slip carrying strap comprising:

a.) an elongated generally flexible body member having an interior cavity, a top surface, a bottom surface, a first side surface, a second side surface, a first end, and a second end;

b.) a plurality of knobby-nips located on said top surface, said bottom surface, and said first and second side surfaces;

c.) a strap having first and second ends, where said strap is enclosed within and attached to said body member; and d.) a flexible buffer member having first and second ends, where said buffer member is disposed within the interior cavity of said body member and attached to said body member and said strap.

5. The non-slip carrying strap according to claim 4, where said body member further includes end closure segments encasing the respective said first and second ends of the body member.

6. The non-slip carrying strap according to claim 4, wherein said body portion and the plurality of said knobby-nips are manufactured from a polymeric material.

* * * * *